US010006320B2

(12) United States Patent
Amano et al.

(10) Patent No.: US 10,006,320 B2
(45) Date of Patent: Jun. 26, 2018

(54) SYSTEM FOR CONTROLLING VALVE OPENING/CLOSING TIMING

(71) Applicant: AISIN SEIKI KABUSHIKI KAISHA, Kariya-shi, Aichi (JP)

(72) Inventors: Hiroyuki Amano, Kariya (JP); Koji Nunami, Obu (JP); Takashi Iwaya, Obu (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 121 days.

(21) Appl. No.: 15/123,943

(22) PCT Filed: Mar. 5, 2015

(86) PCT No.: PCT/JP2015/056470

§ 371 (c)(1),
(2) Date: Sep. 6, 2016

(87) PCT Pub. No.: WO2015/141475

PCT Pub. Date: Sep. 24, 2015

(65) Prior Publication Data

US 2017/0016359 A1 Jan. 19, 2017

(30) Foreign Application Priority Data

Mar. 19, 2014 (JP) ..... 2014-056152

(51) Int. Cl.
*F01L 1/344* (2006.01)
*F01L 1/047* (2006.01)
*F02D 13/02* (2006.01)

(52) U.S. Cl.
CPC ..... *F01L 1/3442* (2013.01); *F01L 1/047* (2013.01); *F02D 13/0219* (2013.01);
(Continued)

(58) Field of Classification Search
CPC ..... F01L 2001/3443; F01L 2001/34453; F01L 2001/34459; F01L 2001/34463;
(Continued)

(56) References Cited

U.S. PATENT DOCUMENTS

2003/0226533 A1* 12/2003 Fujiwara ..... F01L 1/34 123/90.17
2006/0236964 A1* 10/2006 Sawdon ..... F01L 1/3442 123/90.17
(Continued)

FOREIGN PATENT DOCUMENTS

JP 2010-138699 A 6/2010
JP 2011-12576 A 1/2011
(Continued)

OTHER PUBLICATIONS

International Search Report (PCT/ISA/210) dated May 26, 2015, by the Japanese Patent Office as the International Searching Authority for International Application No. PCT/JP2015/056470.
(Continued)

*Primary Examiner* — Jorge Leon, Jr.
(74) *Attorney, Agent, or Firm* — Buchanan Ingersoll & Rooney PC

(57) ABSTRACT

A system for controlling valve opening/closing timing that allows an unlocking operation to be reliably performed is configured. When extracting a lock member from a recess, a second control valve is set to an unlock position, a first control valve is set to a predetermined position, and a relative rotation phase is displaced. As a result, the relative rotation phase is displaced in a direction opposite to the direction of displacement by cam average torque from a camshaft. Afterward, by setting the first control valve to a neutral position, the relative rotation phase is displaced by the cam average torque, and when this displacement occurs, a state in which the lock member is separated from an inner
(Continued)

wall of the recess is created, thus facilitating extraction of the lock member from the recess.

4 Claims, 7 Drawing Sheets

(52) U.S. Cl.
CPC ..... *F01L 2001/3443* (2013.01); *F01L 2001/34426* (2013.01); *F01L 2001/34453* (2013.01); *F01L 2001/34459* (2013.01); *F01L 2001/34463* (2013.01); *F01L 2001/34466* (2013.01); *F01L 2001/34473* (2013.01); *F01L 2001/34483* (2013.01); *F01L 2800/12* (2013.01); *F01L 2800/16* (2013.01); *F01L 2820/041* (2013.01)

(58) Field of Classification Search
CPC ..... F01L 2800/12; F01L 2800/16; F01L 2820/041; F01L 2820/043; F01L 2820/044
USPC ..... 123/90.17, 90.19
See application file for complete search history.

(56) References Cited

U.S. PATENT DOCUMENTS

2009/0007864 A1* 1/2009 Kanafani ..... F01L 1/3442 123/90.15
2010/0139592 A1* 6/2010 Takemura ..... F01L 1/022 123/90.17
2010/0332110 A1 12/2010 Wada et al.
2011/0023805 A1* 2/2011 Takemura ..... F01L 1/3442 123/90.17
2011/0030633 A1 2/2011 Urushihata
2011/0054766 A1* 3/2011 Cowgill ..... F01L 1/344 701/114
2013/0213326 A1* 8/2013 Fujimura ..... F01L 1/34 123/90.12
2014/0150744 A1* 6/2014 Kakuda ..... F02D 13/0219 123/90.17
2014/0366825 A1* 12/2014 Shiozawa ..... F01L 1/3442 123/90.17
2015/0114329 A1 4/2015 Kobayashi

FOREIGN PATENT DOCUMENTS

JP 2011-38446 A 2/2011
JP 2012-219767 A 11/2012
WO WO 2013/187284 A1 12/2013

OTHER PUBLICATIONS

Written Opinion (PCT/ISA/237) dated May 26, 2015, by the Japanese Patent Office as the International Searching Authority for International Application No. PCT/JP2015/056470.

* cited by examiner

SYSTEM FOR CONTROLLING VALVE OPENING/CLOSING TIMING

TECHNICAL FIELD

The present invention relates to a system for controlling valve opening/closing timing, and more specifically, relates to an improvement in technology for reliably unlocking a lock mechanism of a valve opening/closing timing control device.

BACKGROUND ART

Patent Document 1 describes a control mode in which, when an unlock request has occurred, a lock member is driven in an unlocking direction, and while continuing this driving, phase feedback control is not performed until passage of a predetermined time period after occurrence of the unlock request, and after the predetermined time period has passed, control shifts to a feedback control that maintains a relative rotation phase (a camshaft phase in Patent Document 1) near an intermediate lock phase.

CITATION LIST

Patent Literature

Patent Document 1: JP 2010-138699A (claim 11, Paragraphs 0018 to 0021, for example).

SUMMARY OF INVENTION

Technical Problem

A lock mechanism of a valve opening/closing timing control device, as also described in Patent Document 1, is configured with, for example, a lock member supported so as to be capable of moving to one of a drive-side rotary body and a driven-side rotary body, a recess where the lock member is engaged or released in the other of the drive-side rotary body and the driven-side rotary body, and a spring causing a biasing force that causes the lock member to engage in the recess to act.

Also, in the valve opening/closing timing control device, a fluid path is formed that causes pressure of a fluid to act on a lock member that is engaged in a recess for locking, thereby causing the lock member to operate in the unlocking direction, and a control valve is provided that supplies fluid to or discharges fluid from this fluid path.

When unlocking the lock mechanism, there are instances where the relative rotation phase is changed in parallel with an operation to eject the lock member from the recess. In such a case, there may be instances where the lock member is strongly pressed against an inner wall of the recess, and therefore the lock member is unable to move in the unlocking direction. In order to avoid such a situation, in Patent Document 1, control to displace the relative rotation phase is restricted when driving the lock member in the unlocking direction.

However, in a situation in which the internal combustion engine operates, a phenomenon occurs in which a cam average torque from a camshaft acts on the valve opening/closing timing control device, thus displacing the relative rotation phase in a predetermined direction, and as a result, the lock member is pushed against the inner face of the recess.

When the lock member is pressed against the inner face of the recess in this manner, an operation to eject the lock member from the recess is difficult even when not performing an operation to displace the relative rotation phase, so there is room for improvement.

It is an object of the present invention to rationally configure a system for controlling valve opening/closing timing that allows an unlocking operation to be reliably performed.

Solution to Problem

The present invention is characterized by providing:

a valve opening/closing timing control device having: a drive-side rotary body that rotates synchronously with a crankshaft of an internal combustion engine; a driven-side rotary body that is contained within the drive-side rotary body, and rotates in unity and coaxially with a camshaft for valve opening/closing; and a lock mechanism that includes a lock member supported slidably in a guide hole of one of the drive-side rotary body and the driven-side rotary body, a recess formed in the other of the drive-side rotary body and the driven-side rotary body, and a biasing member that biases the lock member, the lock mechanism maintaining the drive-side rotary body and the driven-side rotary body in a lock position where the drive-side rotary body and the driven-side rotary body are held at a predetermined relative rotation phase by the lock member engaging in the recess due to biasing force of the biasing member; and a control unit having: a first control valve that selectively switches, among an advance chamber and a retard chamber formed between the drive-side rotary body and the driven-side rotary body, between an advance position where the relative rotation phase is displaced in an advance direction by supply of a fluid to the advance chamber, and a retard position where the relative rotation phase is displaced in a retard direction by supply of the fluid to the retard chamber, and a neutral position where the relative rotation phase is held by stoppage of supply of the fluid to the advance chamber and the retard chamber; and a second control valve switchable from the lock position to an unlock position by the lock member disengaging from the recess, by fluid pressure acting on the lock member in a direction against the biasing force of the biasing member; the control unit executing phase control that changes the relative rotation phase and unlock control that releases a locked state of the lock mechanism by controlling at least any one of the first control valve and the second control valve, in which the unlock control is executed such that by the second control valve being set to the unlock position, and setting the first control valve to any one of the advance position and the retard position, the lock member contacts an inner wall of the recess based on displacement force in a direction against a cam average torque of the camshaft, and then, by the first control valve being switched to the neutral position, an operation in which the lock member separates from the inner wall due to the cam average torque is performed in a predetermined interval.

According to this configuration, when releasing a locked state of the lock mechanism in the unlock control, the control unit sets the second control valve to the unlock position. In parallel with this setting, by the control unit setting the first control valve to the advance position or the retard position, the relative rotation phase can be displaced in a direction that separates the lock member from one inner wall of the recess against cam variable torque that acts from the camshaft, and the lock member caused to contact another inner wall of the recess. Afterward, by setting the first control valve to an intermediate position, the relative rotation phase is displaced in a direction that the lock member separates from the another inner wall of the recess due to cam variable torque that acts from the camshaft.

By performing this contact and separation in the set interval, a state in which the lock member does not contact an inner wall of the recess is created, and by reducing frictional force that acts on the lock member from an inner wall of the recess, operation of the lock member is allowed to be reliably performed.

As a result, a system for controlling valve opening/closing timing that allows an unlocking operation to be reliably performed is configured.

In the present invention, the interval may also be changed according to temperature of the fluid.

When the temperature of the fluid is low and viscosity is high, even if the fluid is supplied from the first control valve to the advance chamber or the retard chamber, the time period from the start of supply until pressure acts in the advance chamber or the retard chamber and displacement of the relative rotation phase starts becomes longer. For such reasons, by changing the interval according to the temperature of the fluid, it is possible to reliably operate the lock member to a position in contact with another inner wall of the recess, and afterward, create a state in which the lock member is caused to separate from that another inner wall.

In the present invention, the interval may also be changed according to pressure of the fluid.

When the pressure of the fluid is low, even if the fluid is supplied from the first control valve to the advance chamber or the retard chamber, the time period from the start of supply until pressure acts in the advance chamber or the retard chamber and displacement of the relative rotation phase starts becomes longer. For such reasons, by changing the interval according to the pressure of the fluid, it is possible to reliably operate the lock member to a position in contact with another inner wall of the recess, and afterward, create a state in which the recess is caused to separate from that another inner wall.

In the present invention, a configuration may also be adopted in which a phase sensor that detects the relative rotation phase is provided, and in a case where the phase control is executed after the unlock control was continued for a set time period, and even with execution of this phase control, displacement of the relative rotation phase is not detected by the phase sensor, the interval is set to longer than a predetermined value and then the unlock control is executed again.

In a case where a locked state is not released by performing unlock control, displacement of the relative rotation phase is not detected by the phase sensor even if phase control is executed. Accordingly, in a case where displacement of the relative rotation phase is not detected, the interval is set to longer than a predetermined value and then the unlock control is executed again. As a result, the lock member is reliably operated to a position in contact with another inner wall of the recess, and afterward, a state is created in which the lock member is caused to separate from that another inner wall, so it becomes possible to improve the reliability of unlocking.

DESCRIPTION OF EMBODIMENTS

Following is a description of an embodiment of the present disclosure with reference to drawings.

(Basic Configuration)

Figure 1:
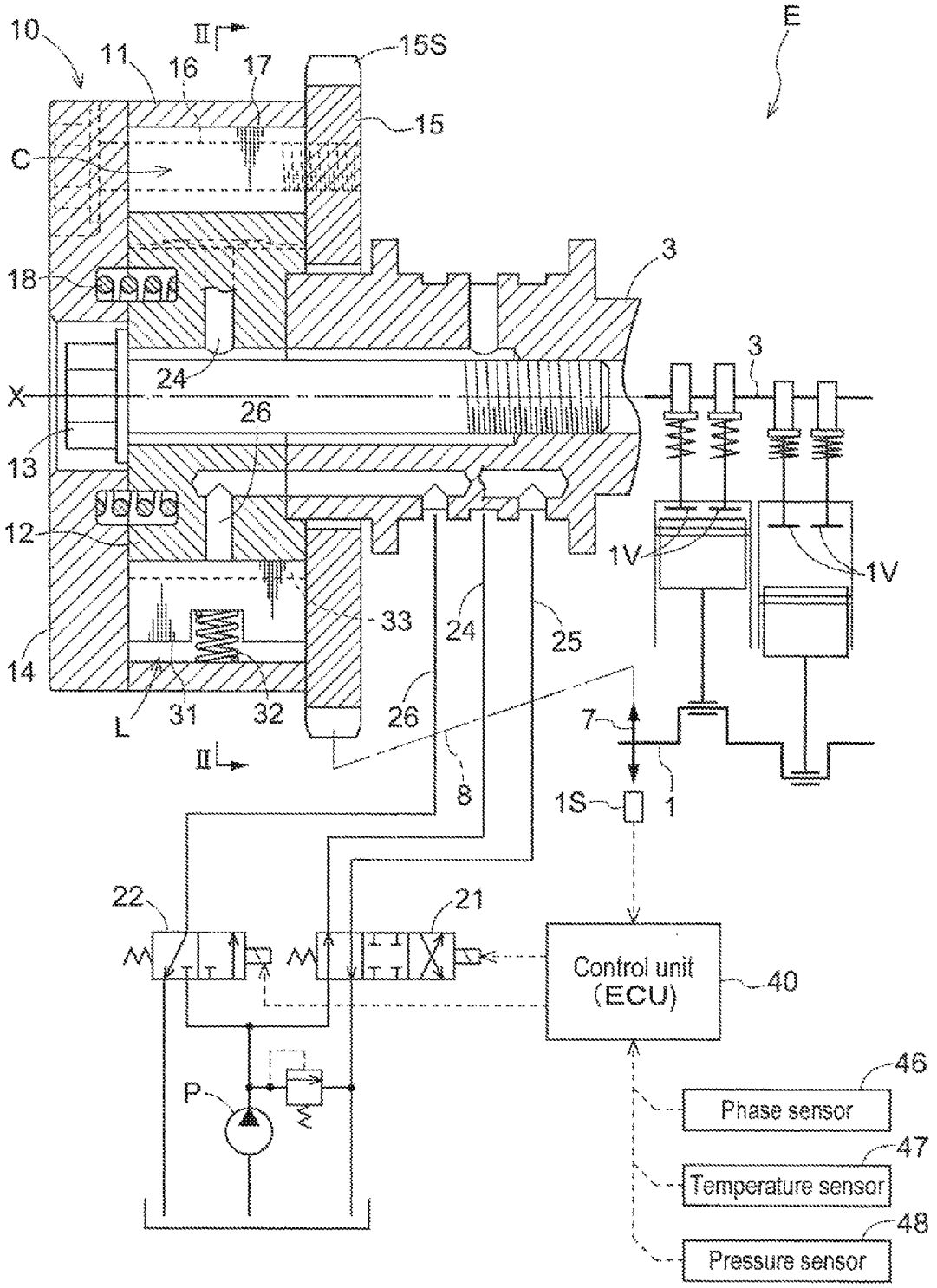
FIG. 1 shows a configuration of a system for controlling valve opening/closing timing.

As shown in FIG. 1, a system for controlling valve opening/closing timing is configured having a valve opening/closing timing control device 10 provided in an intake camshaft 3 of an engine E serving as an internal combustion engine, a phase control valve 21 (one example of a first control valve) that controls a relative rotation phase of the valve opening/closing timing control device 10, a lock control valve 22 (one example of a second control valve) that controls a lock mechanism L of the valve opening/closing control device 10, and also a control unit 40 (ECU).

The engine E is configured as a four-cycle engine provided in a vehicle such as a passenger vehicle, and the valve opening/closing timing control device 10 realizes a change in intake timing by changing the rotation phase of a crankshaft 1 and an intake camshaft 3 of the engine E. The control unit 40 acquires a rotation speed of the engine E, or alternatively, acquires information regarding operation by a driver or the like, and controls the magnetically controlled phase control valve 21 (one example of a first control valve) and the magnetically operated lock control valve 22 (one example of a second control valve).

(Valve Opening/Closing Timing Control Device)

As shown in FIGS. 1 to 4, the valve opening/closing timing control device 10 is provided with an external rotor 11 serving as a drive-side rotary body that rotates synchronously with the crankshaft 1 of the engine E, and an internal rotor 12 serving as a driven-side rotary body connected with a connecting bolt 13 to the intake camshaft 3, which opens/closes intake valves 1V of a combustion chamber of the engine E. The internal rotor 12 is disposed on the same center axis as a rotational center axis X of the intake camshaft 3, and by containing the internal rotor 12 within the external rotor 11, the respective rotors are capable of relative rotation around the rotational center axis X.

The external rotor 11 is fastened by a plurality of fastening bolts 16 in a state held between a front plate 14 and a rear plate 15, and the internal rotor 12 is disposed between the front plate 14 and the rear plate 15. A timing sprocket 15S is formed around the outer circumference of the rear plate 15.

In the external rotor 11, a plurality of protruding portions 11T that protrude to the inside in the radius direction are formed as a single body with the external rotor 11, and the internal rotor 12 is formed in a cylindrical shape having an outer circumference that closely contacts a protruding end of the plurality of protruding portions 11T. Therefore, at an intermediate position of protruding portions 11T that are adjacent in the rotation direction, a plurality of fluid pressure chambers C are formed on the outer circumference side of the internal rotor 12. A plurality of vanes 17 serving as dividing portions are provided at the outer circumference of the internal rotor 12. By dividing a fluid pressure chamber C with a vane 17, an advance chamber Ca and a retard chamber Cb are formed.

The advance chamber Ca is a space that allows the relative rotation phase to be displaced in an advance direction Sa by supplying a working oil. Conversely, the retard chamber Cb is a space that allows the relative rotation phase to be displaced in a retard direction Sb by supplying the working oil.

A timing chain 8 is wrapped around an output sprocket 7 provided in the crankshaft 1 of the engine E and the timing sprocket 15S of the external rotor 11, and thus the external rotor 11 rotates synchronously with the crankshaft 1. Although not shown in the drawings, a device having a similar configuration as the valve opening/closing timing control device 10 is also provided at a front end of the camshaft on an exhaust side, and torque is transmitted from the timing chain 8 to this device as well.

Figure 2:
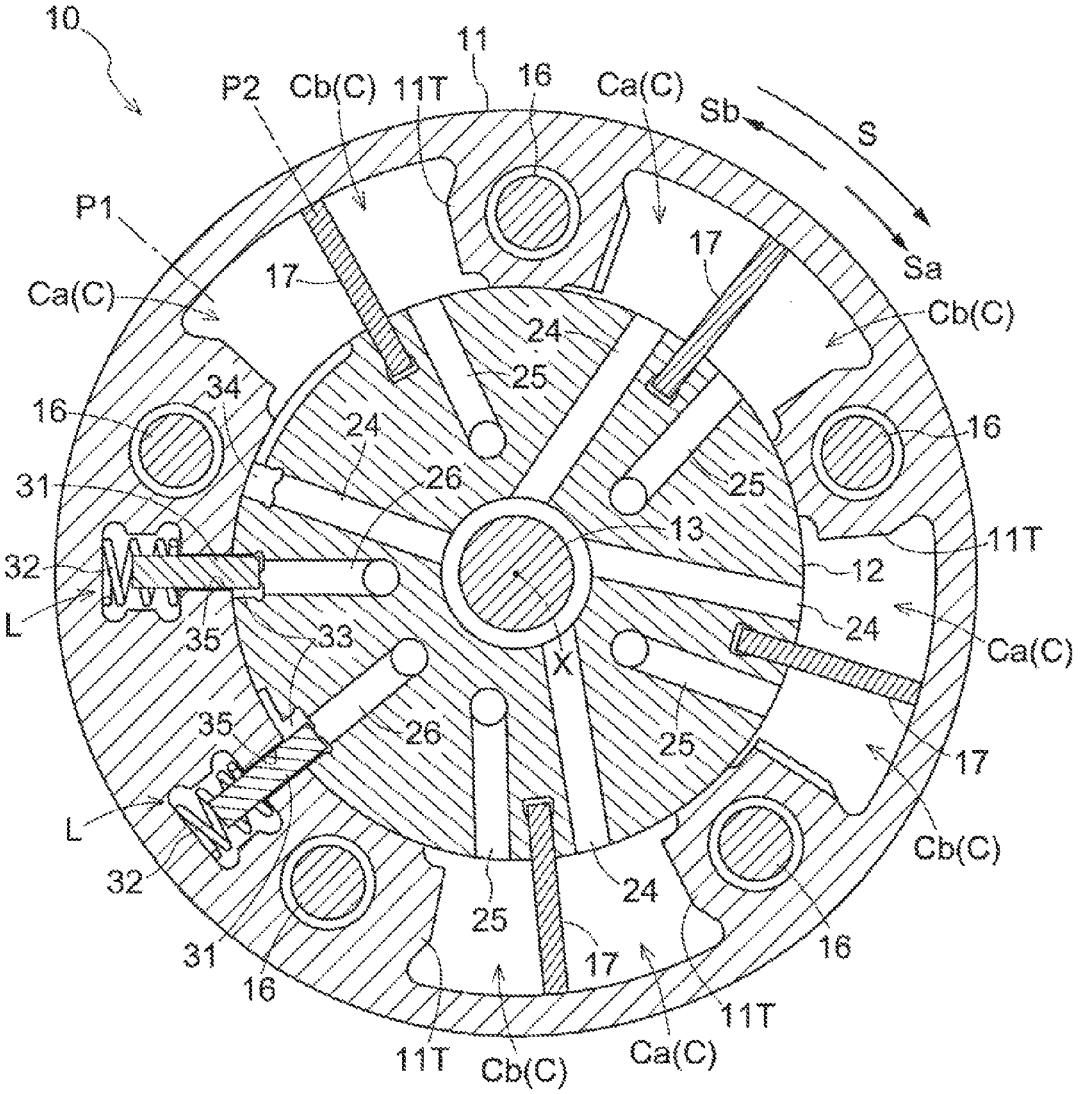
FIG. 2 shows a cross-sectional view taken along line II-II of the valve opening/closing timing control device in FIG. 1.
Figure 3:
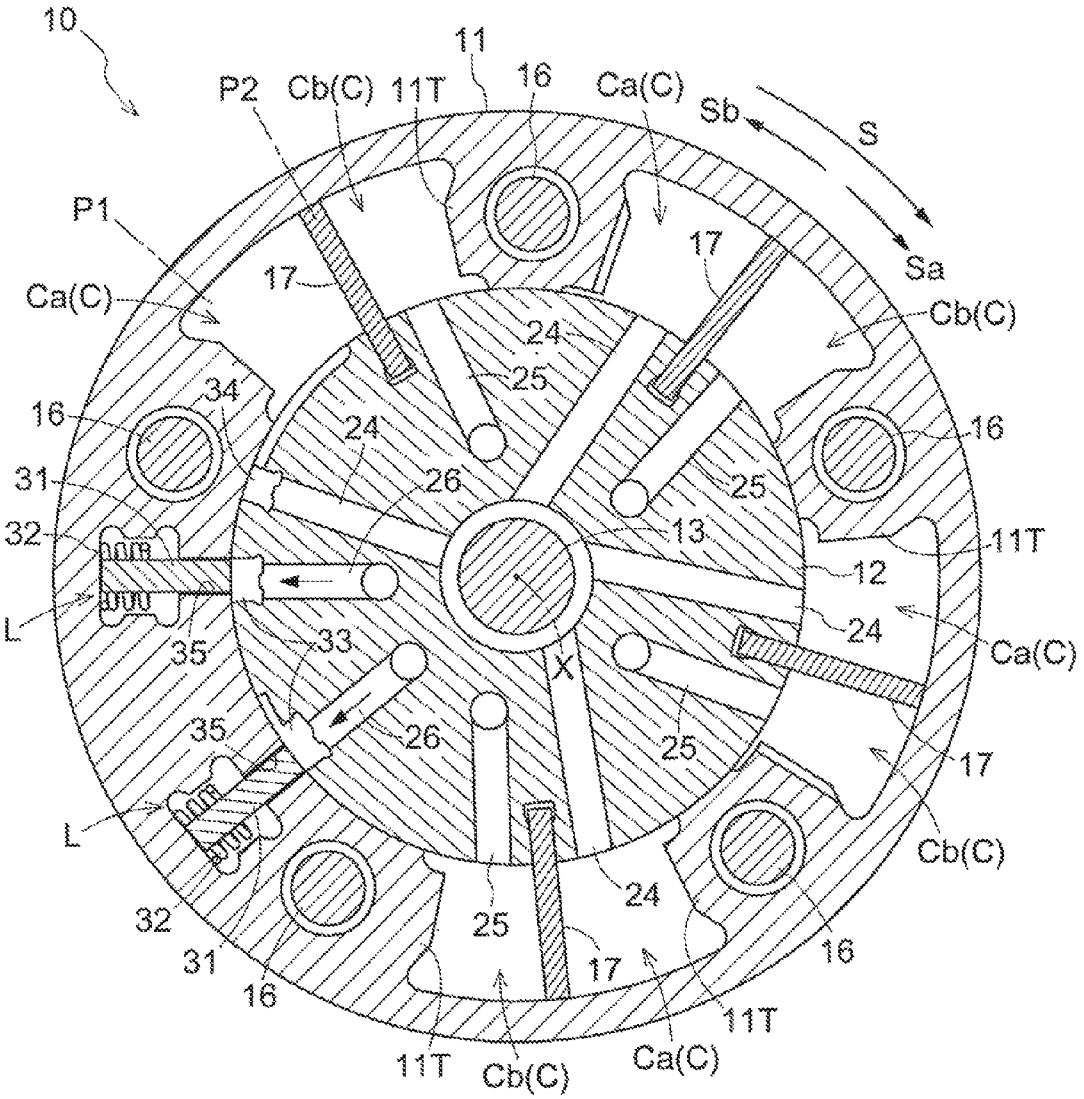
FIG. 3 shows a cross-sectional view of the valve opening/closing timing control device in an unlocked state.

As shown in FIG. 2, in the valve opening/closing timing control device 10, the external rotor 11 rotates in a driving rotation direction S due to driving force from the crankshaft 1. On the other hand, a direction that the internal rotor 12 rotates relative to the external rotor 11 in the same direction as the driving rotation direction S is called an advance direction Sa, and a rotation direction opposite to this direction is called a retard direction Sb.

Also, the relative rotation phase in a state where the vane 17 has attained the end of operation in the advance direction Sa (including a phase near the end of operation of the vane 17 in the advance direction Sa) is called a most advanced phase, and a relative rotation phase in a state where the vane 17 has attained the end of operation in the retard direction Sb (including a phase near the end of operation of the vane 17 in the retard direction Sb) is called a most retarded phase.

As shown in FIG. 1, a torsion spring 18 is provided across the internal rotor 12 and the front plate 14, and causes a biasing force to act until, from a state in which the relative rotation phase of the external rotor 11 and the internal rotor 12 (referred to below as the relative rotation phase) is in a most retarded state, the relative rotation phase attains an intermediate lock phase P2.

(Valve Opening/Closing Timing Control Mechanism: Lock Mechanism)

Figure 4:
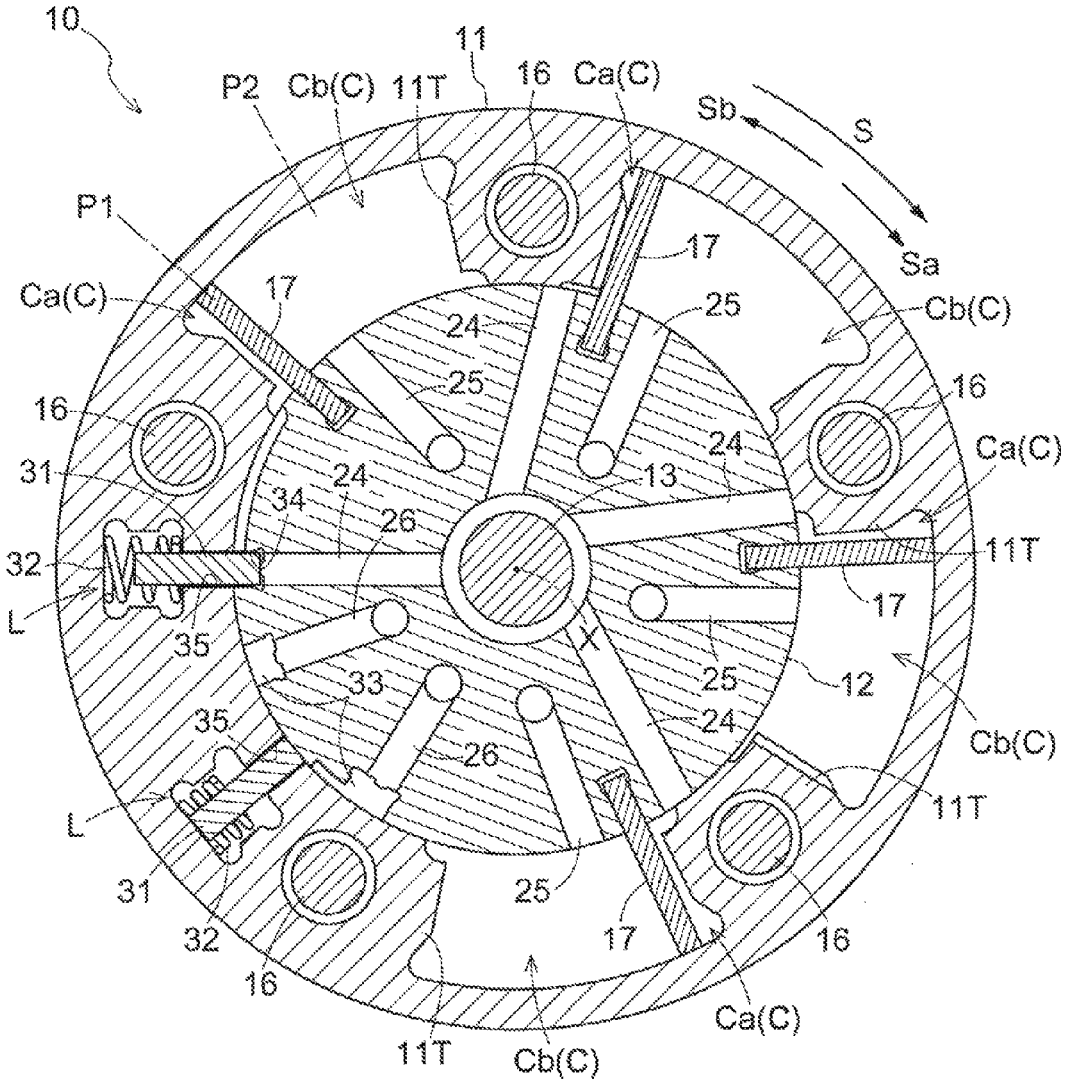
FIG. 4 shows a cross-sectional view of the valve opening/closing timing control device in a most retarded lock phase.

The valve opening/closing timing control device 10 is provided with a pair of the lock mechanisms L that are capable of holding the rotation phase at a most retarded lock phase P1 (one example of a first lock phase) serving as the most retarded phase as shown in FIG. 4, and the intermediate lock phase P2 (one example of a second lock phase), which is intermediate between the most advanced phase and the most retarded phase as shown in FIG. 2.

The respective lock mechanisms L are provided with a pair of lock members 31 that are supported by the external rotor 11 such that a protruding end of the lock members 31 is capable of approaching or separating from the rotational center axis X, and a lock spring 32 (one example of a biasing member) that biases the respective lock members 31 in the protruding direction. A pair of intermediate lock recesses 33 where the pair of lock members 31 independently engage in the intermediate lock phase P2, and a most retarded lock recess 34 where one of the lock members 31 engages when in the most retarded lock phase P1, are formed in the internal rotor 12.

Also, the lock members 31 are configured with plate-like material, and in the external rotor 11, are inserted so as to be capable of sliding movement in guide holes 35 formed in a radial shape centered on the rotational center axis X. The intermediate lock recess 33 and the most retarded lock recess 34 are formed in a groove-like shape having an attitude parallel to the rotational center axis X.

(Hydraulic Control System)

As shown in FIGS. 1 to 4, in the system for controlling valve opening/closing timing, in the engine E, a hydraulic pump P is provided that sucks out oil of an oil pan with driving force of the engine E, and sends this out as the working oil (one example of a fluid), and is provided with a fluid path system that supplies the working oil from the hydraulic pump P to the phase control valve 21 and the lock control valve 22.

Also, an advance fluid path 24 in communication from the phase control valve 21 to the advance chamber Ca of the internal rotor 12, and a retard fluid path 25 in communication from the phase control valve 21 to the retard chamber Cb, are formed, and the advance fluid path 24 is in communication with the most retarded lock recess 34. Further, an unlock fluid path 26 is formed in communication from the lock control valve 22 to the intermediate lock recess 33 of the internal rotor 12.

The phase control valve 21 is configured to be capable of selectively switching between an advance position, a neutral position, and a retard position by adjustment of electrical power supplied to an electromagnetic solenoid of the phase control valve 21. In the advance position, the working oil of the hydraulic pump P is supplied from the advance fluid path 24 to the advance chamber Ca, and the working oil is discharged from the retard chamber Cb, thereby displacing the relative rotation phase in the advance direction Sa.

Also, in the neutral position, the phase control valve 21 maintains the relative rotation phase without supplying fluid to or discharging fluid from the advance fluid path 24 or the retard fluid path 25. In the retard position, the working oil of the hydraulic pump P is supplied from the retard fluid path 25 to the retard chamber Cb, and the working oil is discharged from the advance chamber Ca, thereby displacing the relative rotation phase in the retard direction Sb. The neutral position is positioned between the advance position and the retard position in the movable range of a spool of the phase control valve 21.

The lock control valve 22 is configured to be capable of operation to a lock position and an unlock position by adjustment of electrical power supplied to an electromagnetic solenoid of the lock control valve 22. In the lock position, the working oil is discharged from the unlock fluid path 26, enabling a lock member 31 in the unlock position to shift to a locked state, and maintaining the locked state of a lock member 31 that is already in the lock position.

On the other hand, in the unlock position, the working oil is supplied to the unlock fluid path 26, causing a lock member 31 that is in a state engaged into the intermediate lock recess 33 to operate to a position (an ejecting position) disengaging from the intermediate lock recess 33 against the biasing force of the lock spring 32, thereby releasing the locked state.

(Control Unit/Control Mode)

The control unit 40 is configured as an ECU, where signals are input from a shaft sensor 1S, a phase sensor 46, a temperature sensor 47, and a pressure sensor 48. The shaft sensor 1S detects the rotation speed and the rotation phase of the crankshaft 1. The phase sensor 46 detects the relative rotation phase. The temperature sensor 47 detects cooling water temperature (equivalent to oil temperature of the working oil) of the engine E. The pressure sensor 48 detects the pressure of the working oil discharged from the hydraulic pump P.

In the control unit 40, software that executes phase control, lock shift control, and unlock control is installed. In the phase control, in a state in which a detection signal from the phase sensor 46 is fed back to the control unit 40, the lock control valve 22 is maintained at the unlock position, and by setting the phase control valve 21 to the advance position or the retard position, the relative rotation phase is displaced in the direction of a target relative rotation phase.

In the lock shift control, when holding the relative rotation phase at the intermediate lock phase P2, the lock control valve 22 is set to the lock position, and the phase control valve 21 is set to the advance position or the retard position, thereby displacing the relative rotation phase in the direction of the intermediate lock phase P2. When the relative rotation phase detected by the phase sensor 46 by this displacement has been maintained at the intermediate lock phase P2, it is decided that a locked state has been attained.

In an example of the unlock control executed from a state where the lock mechanism L is in a state locked at the intermediate lock phase P2, the lock control valve 22 is set to the unlock position, and after the lock member 31 has been reliably disengaged from the intermediate lock recess 33, control is performed to shift to the phase control.

The present disclosure is characterized by control to disengage (eject) the lock member 31 from the intermediate lock recess 33, and that control mode is described below.

Figure 5:
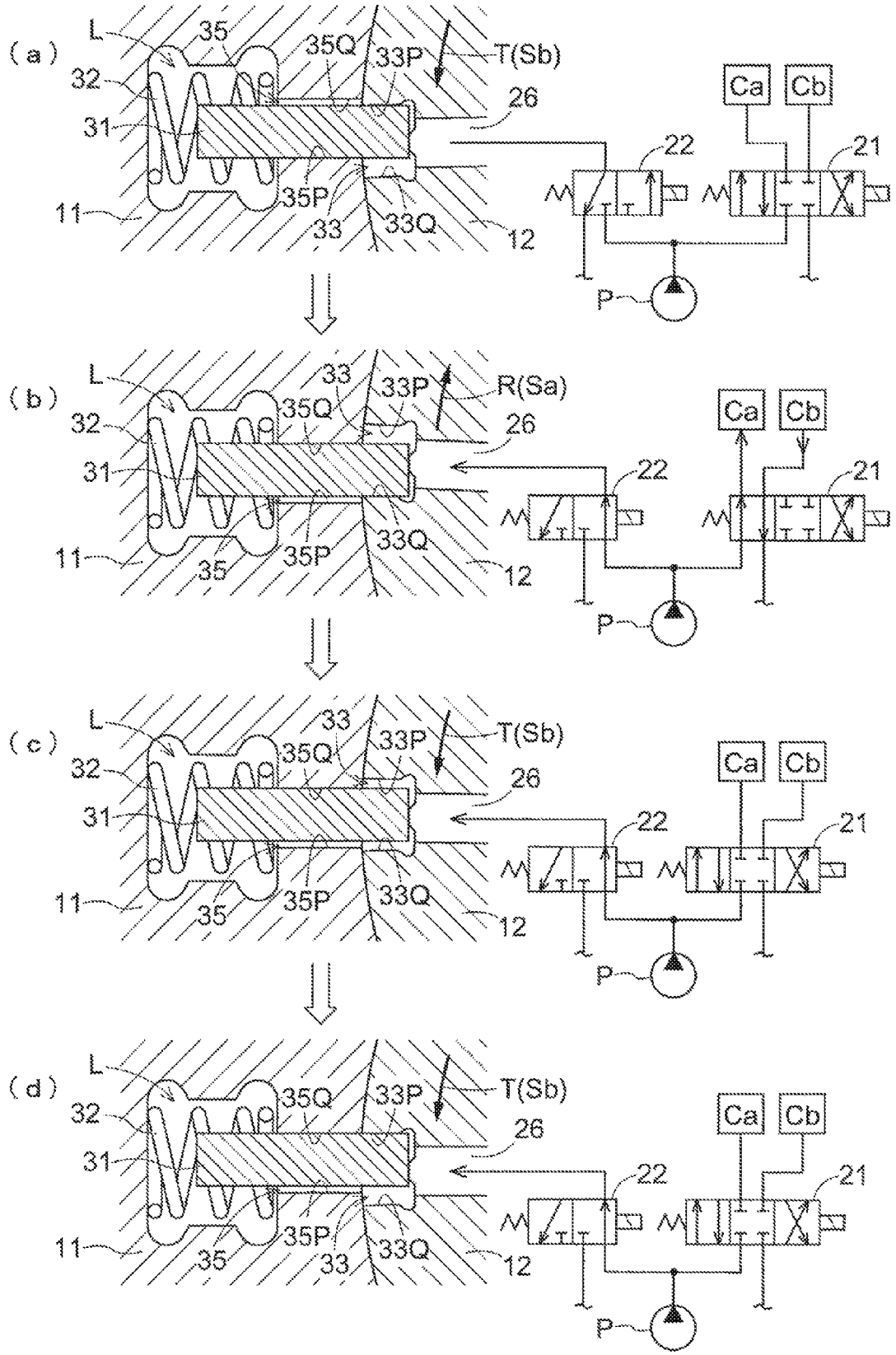
FIG. 5 shows successive changes in the position of a lock member and a lock recess.

When the lock mechanism L is in a state locked at the intermediate lock phase P2, and the working oil is not being supplied to the advance chamber Ca, as shown in FIG. 5(*a*), the relative rotation phase is displaced in the retard direction Sb by a cam average torque T that acts from the intake camshaft 3. Thus, the phase is set to an 'initial phase' in which, as shown in FIG. 5(*a*), an end of the lock member 31 contacts one inner wall (a first wall face 33P) of the intermediate lock recess 33, and an intermediate portion of the lock member 31 contacts one guide face (a first guide face 35P) of the guide hole 35.

Figure 6:
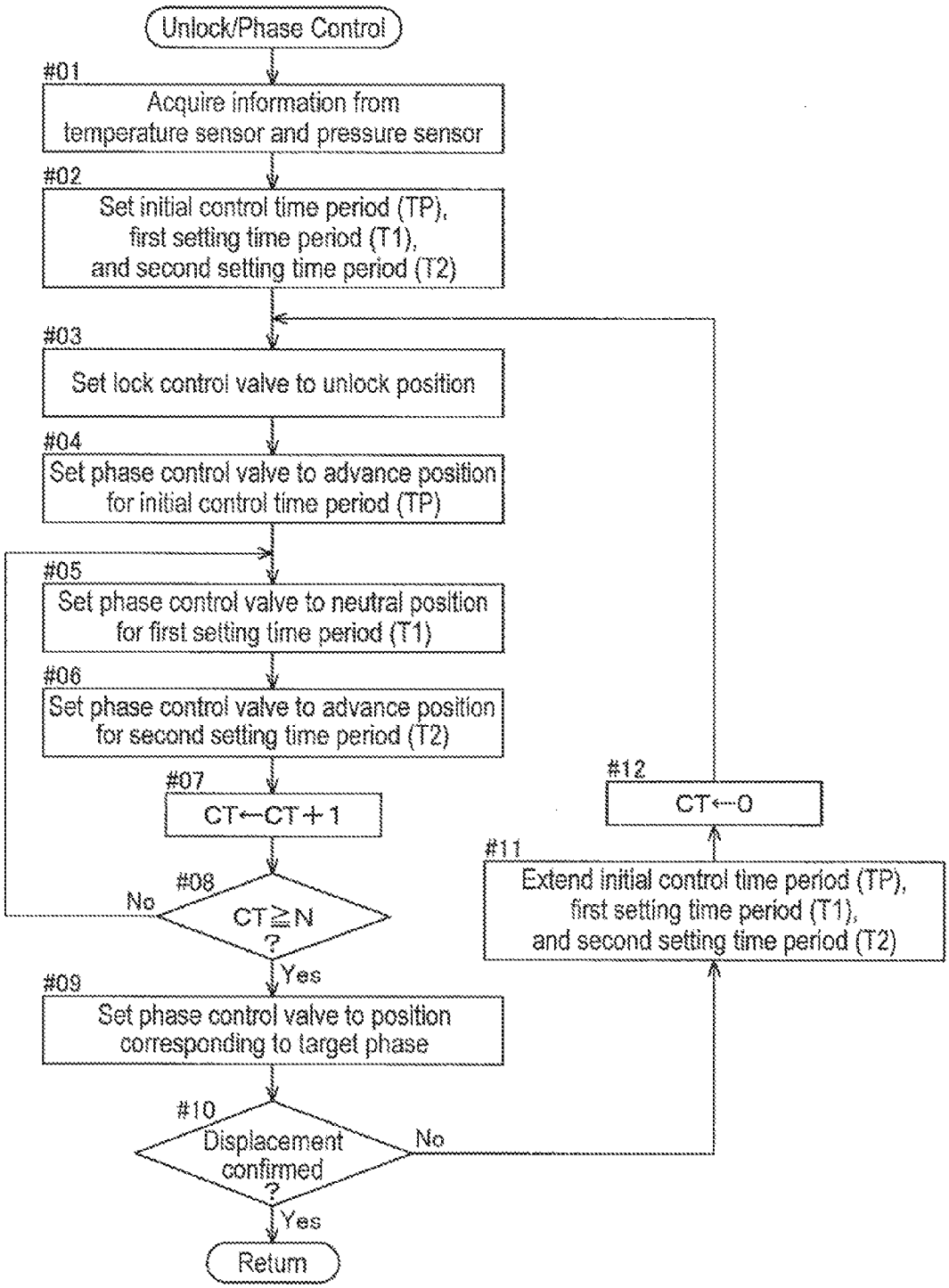
FIG. 6 shows a flowchart of unlocking/phase control.

The flowchart in FIG. 6 shows an overview of 'unlock/phase control' to disengage the lock member 31 in such a contact state from the intermediate lock recess 33, and displace the relative rotation phase. In this control, oil temperature information is acquired from the temperature sensor 47, oil pressure information of the working oil is acquired from the pressure sensor 48, and based on these items of information, an initial control time period (TP), a first setting time period (T1), and a second setting time period (T2) are set (steps #01 and #02).

Figure 7:
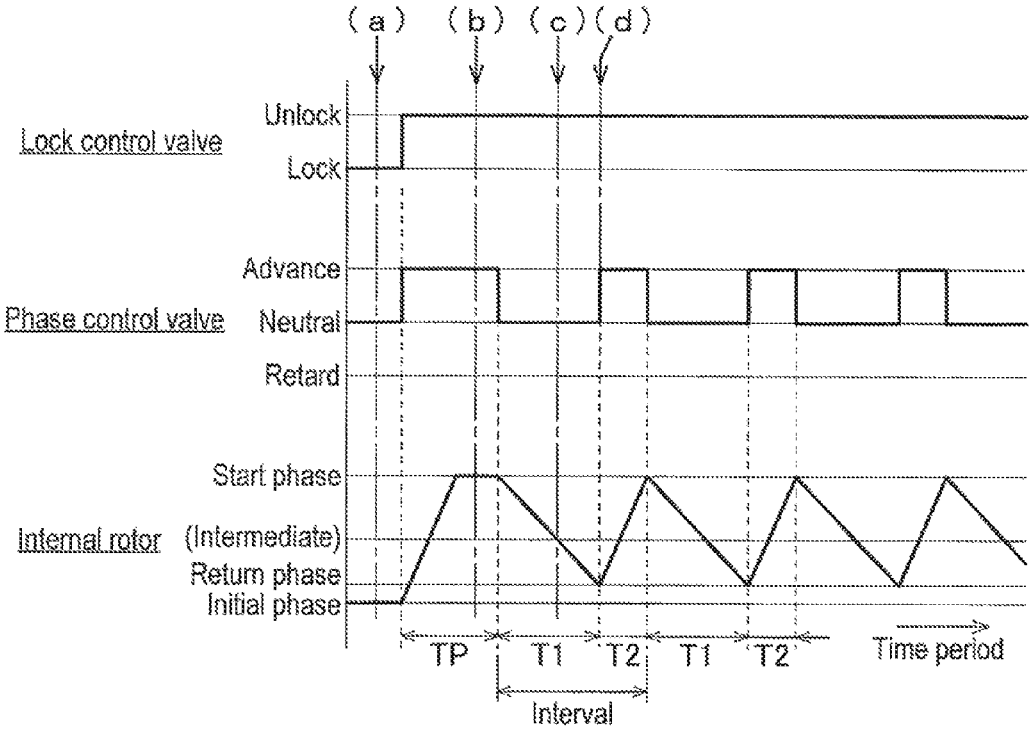
FIG. 7 is a timing chart showing the relationship of a lock control valve, a phase control valve, and an internal rotor.

The timing chart in FIG. 7 shows the relationship between the initial control time period (TP), the first setting time period (T1), and the second setting time period (T2). Also, in the present disclosure, a value (summed value) obtained by adding the first setting time period (T1) and the second setting time period (T2) is an interval used as a period for creating a situation that facilitates release of the locked state of the lock member 31.

The initial control time period (TP), the first setting time period (T1), and the second setting time period (T2) are stored in advance as table data or the like associated with oil temperature information and oil pressure information, and in step #02, a processing mode is set such that data stored in advance is read out. Note that a configuration may also be adopted in which the initial control time period (TP), the first setting time period (T1), and the second setting time period (T2) are stored as initial values of predetermined values, and the processing mode is set so as to set the respective time periods by performing a calculation on the initial values, such as multiplying a coefficient based on the temperature information or the pressure information.

In this control, when the oil temperature of the working oil is low and viscosity is high, the speed of displacement of the relative rotation phase in any direction among the advance direction Sa and the retard direction Sb decreases. Also, when the oil temperature of the working oil is high and viscosity is low, the speed of displacement of the relative rotation phase decreases due to leakage of the working oil. Similarly, when the pressure of the working oil discharged from the hydraulic pump P is low, the speed of displacement in a case where the working oil has been supplied to any of the advance chamber Ca and the retard chamber Cb decreases. In order to eliminate such problems, the respective time periods are set in step #02.

Next, by setting the lock control valve 22 to the unlock position, oil pressure is caused to act in the unlock fluid path 26, and thus the phase control valve 21 operates to the advance position for the initial control time period (TP) (steps #03 and #04).

In step #03, first a state is created in which oil pressure is caused to act continuously on the lock member 31 in the unlocking direction. In step #04, by operating the phase control valve 21 to the advance position for the initial control time period (TP), the relative rotation phase is displaced in the advance direction Sa by a torque R against the above-described cam average torque T due to pressure of the working oil that acts in the advance chamber Ca, and thus the internal rotor 12 is set to a 'start phase' shown in FIG. 5(*b*).

In the 'start phase', an end of the lock member 31 is separated from the first wall face 33P by the torque R, and this end is caused to contact a second wall face 33Q at a position opposing the first wall face 33P. At the same time, the intermediate portion of the lock member 31 is separated from the first guide face 35P, and caused to contact a second guide face 35Q at a position opposing the first guide face 35P. The initial control time period (TP) is set so as to attain this sort of position relationship.

Next, the phase control valve 21 is operated to the neutral position for the first setting time period (T1), and afterward, the phase control valve 21 is operated to the advance position for the second setting time period (T2) (steps #05 and #06).

When the phase control valve 21 has been set to the neutral position by the control in step #05, the working oil is not supplied to the advance chamber Ca and the retard chamber Cb. Accordingly, displacement of the relative rotation phase in the retard direction Sb is started by the phenomenon of the working oil leaking from the advance chamber Ca, and action of the cam average torque T that acts from the intake camshaft 3. This displacement is performed at a low speed, and by this displacement, the lock member 31 attains a 'return phase' shown in FIG. 5(*d*), through the phase shown in FIG. 5(*c*).

The first setting time period (T1) is set to a time period shorter than the time period in which the lock member 31 attains the 'initial phase', and is set such that after the first setting time period (T1) has passed, the lock member 31 attains the 'return phase'.

Afterward, by the control in step #06, by setting the phase control valve 21 to the advance position for the second setting time period (T2), the second setting time period (T2) is set such that the internal rotor 12 is returned to the 'start phase' shown in FIG. 5(*b*).

That is, after setting the internal rotor 12 to the 'start phase' shown in FIG. 5(*b*), in a case where the relative rotation phase is displaced in the retard direction Sb by leakage of the working oil and the cam average torque T that acts from the intake camshaft 3, this displacement is caused to be performed at low speed, so the phase control valve 21 is set to the neutral position, and not set to the advance position.

Thus, a state is created in which the lock member 31 separates from the guide face of the guide hole 35 at the same time as separating from the wall face of the intermediate lock recess 33, so a reduction of resistance that acts on the lock member 31 is realized. Because the resistance that acts on the lock member 31 is reduced in this way, ejection of the lock member 31 from the intermediate lock recess 33 by the oil pressure that acts on the lock member 31 is facilitated.

Also, in this control, the 'return phase' is determined by the first setting time period (T1), but the 'return phase' is not a predetermined phase. Therefore, the interval may also be set such that the 'return phase' shown in FIG. 5(*d*) matches the 'initial phase' shown in FIG. 5(*a*).

Also, the control to displace the relative rotation phase from the 'start phase' to the 'return phase', and afterward return to the 'start phase', is repeatedly performed until a counter value CT, indicating a number of times of this return, attains a value N that has been set in advance. After this return has been attained N times, the relative rotation phase is displaced by setting the phase control valve 21 to a position (the advance position or the retard position) corresponding to the target phase (steps #07 to #09).

Next, when the control in step #09 has been executed, in a case where displacement of the relative rotation phase in the direction of the target phase could not be confirmed with detection by the phase sensor 46, the first setting time period (T1) and the second setting time period (T2) are extended, and again the control from step #03 onward is repeatedly executed (steps #10 to #12).

OTHER EMBODIMENTS

Other than the embodiment described above, the present disclosure may also be configured as follows.

(a) This other embodiment (a) applies to a configuration in which the valve opening/closing timing control device 10 is provided in an exhaust camshaft. In a valve opening/closing timing control device 10 provided in an exhaust camshaft, cam average torque from the exhaust camshaft acts in the advance direction Sa. Accordingly, in the 'initial phase', the lock member 31 contacts a wall face/guide face that is opposite to those shown in FIG. 5(*a*). Therefore, the phase control valve 21 is set to the retard position in order to shift to the 'start phase', but the control mode of the phase control valve 21 is merely reversed, and the control mode for releasing the locked state of the lock mechanism L can be performed in a manner basically the same as described in the above embodiment.

With the configuration of this other embodiment (a) as well, it is possible to reliably unlock a lock mechanism L of the valve opening/closing timing control device 10 provided in an exhaust camshaft.

(b) A control mode is set such that the first setting time period (T1) and the second setting time period (T2) are set based on a rotation speed of the engine E detected by the shaft sensor 1S, without using detection results of the pressure sensor 48. That is, as the rotation speed of the engine E increases, the oil pressure of the working oil discharged from the hydraulic pump P also increases. Accordingly, by adopting such settings, even without providing the pressure sensor 48, it is possible to reflect the oil pressure in the interval, and therefore the configuration also becomes simpler and less expensive.

(c) As the phase sensor 46, a sensor is used that has properties of being able to detect displacement of an end of the lock member 31 between the first wall face 33P and the second wall face 33Q of the intermediate lock recess 33. In this configuration, the phase control valve 21 is set to the neutral position, a time period until the phase sensor 46 detects that the lock member 31 has attained displacement from the 'start phase' to the 'return phase' is used as the first setting time period (T1), and a time period until the phase sensor 46 detects that the lock member 31 has attained the 'start phase' is used as the second setting time period (T2). In this control, changing the first setting time period (T1) and the second setting time period (T2) becomes possible by changing the 'return phase'.

Also, in this other embodiment (c), the phase control valve 21 is set to the advance position after the phase sensor 46 has detected that the lock member 31 has attained the 'return phase', and by setting the phase control valve 21 to the advance position, feedback control to set the phase control valve 21 to the neutral position becomes possible after the lock member 31 has attained the 'start phase'.

(d) As the configuration of the lock mechanism L, a configuration may be adopted in which a single lock member 31 is provided, or a configuration may be adopted in which, for example, the lock member 31 is provided so as to be movable relative to a vane of the internal rotor 12 in a direction along the rotational center axis X, and the intermediate lock recess 33 is formed in the rear plate 15.

(e) A configuration may also be adopted in which, for example, in a case where displacement of the relative rotation phase cannot be confirmed in step #10 of the above-described flowchart, and so the initial control time period (TP), the first setting time period (T1), and the second setting time period (T2) are extended, the time periods thus extended are set as initial values and stored in a memory or the like.

By storing initial values that have been extended in this way, based on information acquired afterward from the temperature sensor 47, the pressure sensor 48, and the like, it is possible to set the initial control time period (TP), the first setting time period (T1), and the second setting time period (T2) to appropriate values.

INDUSTRIAL APPLICABILITY

The present invention is applicable to valve opening/closing timing control devices provided with a lock mechanism causing a lock member to be engaged in or released from a lock recess.

REFERENCE SIGNS LIST

1: crankshaft
3: camshaft (intake camshaft)
10: valve opening/closing timing control device
11: drive-side rotary body (external rotor)
12: driven-side rotary body (internal rotor)
21: first control valve (phase control valve)
22: second control valve (lock control valve)
31: lock member
32: biasing member (lock spring)
33: recess (intermediate lock recess)

33P: inner wall (first wall face)
35: guide hole
40: control unit
46: phase sensor
Ca: advance chamber
Cb: retard chamber
E: internal combustion engine (engine)
L: lock mechanism
T: cam average torque

The invention claimed is:

1. A system for controlling valve opening/closing timing, comprising:

a valve opening/closing timing control device having:

a drive-side rotary body that rotates synchronously with a crankshaft of an internal combustion engine;

a driven-side rotary body that is contained within the drive-side rotary body, and rotates in unity and coaxially with a camshaft for valve opening/closing; and a lock mechanism that includes a lock member supported slidably in a guide hole of one of the drive-side rotary body and the driven-side rotary body, a recess formed in the other of the drive-side rotary body and the driven-side rotary body, and a biasing member that biases the lock member, the lock mechanism maintaining the drive-side rotary body and the driven-side rotary body in a lock position where the drive-side rotary body and the driven-side rotary body are held at a predetermined relative rotation phase position by the lock member engaging in the recess due to biasing force of the biasing member; and a control unit having:

a first control valve that selectively switches, among an advance chamber and a retard chamber formed between the drive-side rotary body and the driven-side rotary body, between an advance position where a relative rotation phase is displaced in an advance direction by supply of a fluid to the advance chamber, and a retard position where the relative rotation phase is displaced in a retard direction by supply of the fluid to the retard chamber, and a neutral position where the relative rotation phase is held by stoppage of supply of the fluid to the advance chamber and the retard chamber; and a second control valve switchable from the lock position to an unlock position by the lock member disengaging from the recess, by fluid pressure acting on the lock member in a direction against the biasing force of the biasing member;

the control unit executing phase control that changes the relative rotation phase and unlock control that releases a locked state of the lock mechanism by controlling at least any one of the first control valve and the second control valve, wherein the unlock control is executed such that by the second control valve being set to the unlock position, and setting the first control valve to any one of the advance position and the retard position, the lock member contacts an inner wall of the recess based on displacement force in a direction against a cam average torque of the camshaft, and then, by the first control valve being switched to and maintained at the neutral position, an operation in which the lock member separates from the inner wall due to the cam average torque is performed in a predetermined interval.

2. The system for controlling valve opening/closing timing according to claim 1, wherein the predetermined interval is changed according to temperature of the fluid.

3. The system for controlling valve opening/closing timing according to claim 1, wherein the predetermined interval is changed according to pressure of the fluid.

4. The system for controlling valve opening/closing timing according to claim 1, comprising a phase sensor that detects the relative rotation phase, wherein in a case where the phase control is executed after the unlock control was continued for a set time period, and even with execution of this phase control, displacement of the relative rotation phase is not detected by the phase sensor, the predetermined interval is set to longer than a predetermined value and then the unlock control is executed again.

* * * * *